US007605766B2

(12) United States Patent
Dahlström et al.

(10) Patent No.: US 7,605,766 B2
(45) Date of Patent: Oct. 20, 2009

(54) MULTI-BAND ANTENNA DEVICE FOR RADIO COMMUNICATION TERMINAL AND RADIO COMMUNICATION TERMINAL COMPRISING THE MULTI-BAND ANTENNA DEVICE

(75) Inventors: Anders Dahlström, Vellinge (SE); Scott Vance, Staffanstorp (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 11/997,576

(22) PCT Filed: Aug. 3, 2006

(86) PCT No.: PCT/EP2006/065041

§ 371 (c)(1),
(2), (4) Date: Aug. 1, 2008

(87) PCT Pub. No.: WO2007/017465

PCT Pub. Date: Feb. 15, 2007

(65) Prior Publication Data

US 2009/0002243 A1 Jan. 1, 2009

Related U.S. Application Data

(60) Provisional application No. 60/709,270, filed on Aug. 18, 2005.

(30) Foreign Application Priority Data

Aug. 5, 2005 (EP) ..... 05017143

(51) Int. Cl.
*H01Q 1/24* (2006.01)

(52) U.S. Cl. ..... 343/702; 343/700 MS; 343/895

(58) Field of Classification Search ..... None
See application file for complete search history.

(56) References Cited

U.S. PATENT DOCUMENTS

| | | | | |
|---|---|---|---|---|
| 6,642,893 | B1 | 11/2003 | Hebron et al. | |
| 2005/0110692 | A1 * | 5/2005 | Andersson | 343/702 |
| 2005/0110693 | A1 * | 5/2005 | Ryu | 343/702 |
| 2006/0033668 | A1 * | 2/2006 | Ryu | 343/702 |

FOREIGN PATENT DOCUMENTS

| | | | |
|---|---|---|---|
| EP | 1 137 101 | A2 | 3/2001 |
| EP | 1 372 213 | A1 | 11/2002 |
| WO | WO 99/56345 | | 11/1999 |
| WO | WO 2004/057701 | A1 | 7/2004 |

OTHER PUBLICATIONS

International Search Report for PCT/EP2006/065041, mailed Oct. 26, 2006.

* cited by examiner

*Primary Examiner*—Trinh V Dinh
(74) *Attorney, Agent, or Firm*—Renner, Otto, Boiselle & Sklar, LLP

(57) ABSTRACT

A multi-band radio antenna device (1) for a radio communication terminal is disclosed. The antenna device comprises a substrate and a radiating antenna element thereon having a radio signal feeding point (13), wherein the radiating element comprises a continuous trace of conductive material. The continuous trace has a first radiating portion connected to said radio signal feeding point comprising a at least partly meandered radiating portion (11) arranged distal from said radio signal feeding point (13) and connected to an elongate radiating portion (10) arranged proximal to and connected to said signal feeding point, and a second radiating portion (12) connected as a branch to said first radiating portion at a branching position (14) thereof arranged distal from said radio signal feeding point (13). The antenna device offers a minimized number of necessary contacts and improved antenna efficiency.

20 Claims, 9 Drawing Sheets

MULTI-BAND ANTENNA DEVICE FOR RADIO COMMUNICATION TERMINAL AND RADIO COMMUNICATION TERMINAL COMPRISING THE MULTI-BAND ANTENNA DEVICE

RELATED APPLICATIONS

This is a U.S. National Phase Application under 35 U.S.C. & 371 of International Patent Application No. PCT/EP2006/065041, filed Aug. 03, 2006 which claims benefit of 60/709,270 filed Aug. 18, 2005, and claims the benefit of EPO PCT/EP2006/06541 filed Aug. 03, 2006 and EPO 05017143.8 filed Aug. 05, 2005.

FIELD OF THE INVENTION

This invention pertains in general to the field of antennas for radio communication terminals and, in particular, to compact built-in antennas devised to be incorporated into mobile or portable radio communication terminals and having a wide bandwidth to facilitate operation of such terminals within multiple frequency bands. Furthermore, the invention pertains to a method of tuning such an antenna and a manufacturing process for an antenna.

BACKGROUND OF THE INVENTION

The use of radio communication networks is rapidly becoming a part of the daily life for more and more people around the globe. For instance, the GSM (Global System for Mobile Communications) networks offer a variety of functions. Generally, radio communication systems based on such networks use radio signals transmitted by a base station in the downlink over the traffic and control channels are received by mobile or portable radio communication terminals, each of which have at least one antenna. Historically, portable terminals have employed a number of different types of antennas to receive and transmit signals over the air interface. For example, monopole antennas mounted perpendicularly to a conducting surface have been found to provide good radiation characteristics, desirable drive point impedances and relatively simple construction. Monopole antennas can be created in various physical forms. For example, rod or whip antennas have frequently been used in conjunction with portable terminals. For high frequency applications where an antenna's length is to be minimized, another choice is the helical antenna. In addition, mobile terminal manufacturers encounter a constant demand for smaller and smaller terminals. This demand for miniaturization is combined with desire for additional functionality such as having the ability to use the terminal at different frequency bands, e.g. of different cellular systems, so that a user of the mobile terminal may use a single, small radio communication terminal in different parts of the world having cellular networks operating according to different standards at different frequencies.

Further, it is commercially desirable to offer portable terminals, which are capable of operating in widely different frequency bands, e.g., bands located in the 800 MHz, 900 MHz, 1800 MHz, 1900 MHz and 2.0 GHz regions. Accordingly, antennas, which provide adequate gain and bandwidth in a plurality of these frequency bands will need to be employed in portable terminals. Several attempts have been made to create such antennas.

In order to reduce the size of the portable radio terminals, built-in antennas have been implemented over the last couple of years. The general desire today is to have an antenna, which is positioned inside the housing of a mobile communication terminal. The most common built-in antennas currently in use in mobile phones are the so-called planar inverted-F antennas (PIFA). This name has been adopted due to the fact that the antenna looks like the letter F tilted 90 degrees in profile. Such an antenna needs a feeding point as well as a ground connection. If one or several parasitic elements are included nearby, they can be either coupled to ground or dielectrically separated from ground. The height of the PIFA antennas is often a limiting factor for decreasing the size of the mobile communication terminal. The geometry of a conventional PIFA antenna includes a radiating element, a feeding pin for the radiating element, a ground pin for the radiating element, and a ground substrate commonly arranged on a printed circuit board (PCB). Both the feeding pin and the ground pin are necessary for the operation of such an antenna, and are arranged perpendicular to the ground plane, wherein the PIFA radiating element is suspended above the ground plane in such a manner that the ground plane covers the area under the radiating element. This type of antenna, however, generally has a fairly small bandwidth in the order of 7% of the operating frequency. In order to increase the bandwidth for an antenna of this design, the vertical distance between the radiating element and the PCB ground may be increased, i.e. the height at which the radiating element is placed above the PCB is increased. This, however, is an undesirable modification as the height increase makes the antenna unattractive for small communication devices and may reduce directivity. One solution to this problem is to add a dielectric element between the antenna and the PCB, in order to make the electrical distance longer than the physical distance. U.S. Pat. No. 6,326,921 to Ying et al discloses a built-in, low-profile antenna with an inverted planar inverted F-type (PIFA) antenna and a meandering parasitic element, and having a wide bandwidth to facilitate communications within a plurality of frequency bands. A main element is placed at a predetermined height above a substrate of a communication device and the parasitic element is placed on the same substrate as the main antenna element and is grounded at one end. The feeding pin of the PIFA is proximal to the ground pin of the parasitic element. The coupling of the meandering, parasitic element to the main antenna results in two resonances, which are adjusted to be adjacent to each other in order to realize a broader resonance encompassing the DCS (Digital Cross-Connect System), PCS (Personal Communications System) and UMTS (Universal Mobile Telephone System) frequency ranges. However, prior art antenna designs will still be a limiting factor when developing radio terminals with adequate bandwidth to cover, for example, all of the DCS, PCS and UMTS frequency bands, at the same time recognizing the desire to provide compact terminals.

The known solutions have mainly dual band performance, e.g. EGSM+DCS, or triple band performance. However, both GSM and EGSM (EGSM is an acronym for Extended Global System for Mobile communications—Extended GSM) are generally not achievable by the prior art antenna solutions fulfilling the above mentioned spatial requirements, i.e. known antennas of the discussed type are not capable of operating efficiently in both the GSM 850 MHz and the EGSM 900 MHz bands.

US-A1-2005/0110692 discloses a multi-band radio antenna device having a flat ground substrate, a flat main radiating element, and flat parasitic elements separated from the main radiating element and connected to ground. The main radiating element is located adjacent to and in the same plane as the flat ground substrate. This planar requirement restrains the design possibilities of the radiating element, which must be oriented in the same plane as the ground substrate, i.e. the antenna is limited to flat, planar implementations. Furthermore, this antenna device necessitates a plurality of separated individual elements besides the radiating element, including the parasitic elements, which each need an individual contact. Moreover, the efficiency of this antenna should be improved, e.g. in order to enhance battery life of a mobile communication terminal using such an antenna device.

Most existing solutions use a ¼ wave for the high-band configuration, as the aforementioned antenna device of US-A1-2005/0110692.

EP-A-1 263 079 discloses an antenna comprising a driven element and a parasitic element resonant at different frequencies so that the antenna has a bandwidth encompassing both resonant frequencies. A second driven element, resonant at a third frequency, may be added so that the antenna is also usable in a third different separate band. This element may also be in the form of a meander. However, the shorter radiating element of the antenna arrangement is at least partly shaped into acute angles in zigzag and used as ¼ wave radiating element for the high-band. Further, the radiating elements are placed near the feeding point.

US 2003/210188 A1 discloses a multi-band antenna system including a retractable whip antenna and a meander antenna having a plurality of selectively coupled meander elements formed on a dielectric flexible board. However, this antenna system is not related to compact built-in antennas devised to be incorporated into mobile or portable radio communication terminal.

WO 99/56345 A discloses a multi-band antenna device comprising a plate element, on which at least two antenna elements intended for transmitting and receiving are formed. They have a common feeding point. The shorter radiating element of the antenna arrangement is at least partly shaped into acute angles in zigzag and used as ¼ wave radiating element for the high-band. Further, the radiating elements are placed near the feeding point.

Other known solutions are variable pitch meanders have been used in the past on stub antennas to achieve dual-band performance, but are generally difficult to tune and cannot be used more generally in PIFA configurations.

More specifically, these prior art antennas generally rely on ¼ wave elements to form the primary resonances in the high-bands. In certain cases, the antenna can be designed such that there are significant currents on the high-band as well as the low-band elements. This tends to improve the high-band efficiency and bandwidth significantly. However, ½ wave elements for the 1800 band were up to now not implemented due to the space requirements. This generally means that the PCS efficiency of known antennas differs from their DCS efficiency, typically it is 1-2 dB higher. Also, because it is common to use two resonances in the high-band, a significant amount of tuning is required to center these resonances around 50 Ohms in order to achieve optimum gain.

A more general problem with known built-in antennas is not only small bandwidth, but also significantly worse gain performance than a traditional external antenna i.e. some kind of stub antenna.

Furthermore electrical contacts are expensive, at least with regard to mass produced products, such as mobile communication terminals. As mentioned above, the PIFA antenna type needs at least two contacts, and often even more contacts for the additional parasitic elements. Hence, it would be advantageous to minimize the number of contacts that a multi-band radio antenna device needs for assembly in a mobile communication terminal.

Hence, an improved multi-band radio antenna device would be advantageous and in particular a multi-band radio antenna device allowing for increased efficiency with regard to e.g. size, cost, bandwidth, design flexibility and/or energy consumption of the multi-band radio antenna device would be advantageous.

SUMMARY OF THE INVENTION

Accordingly, the present invention preferably seeks to mitigate, alleviate or eliminate one or more of the above-identified deficiencies in the art and disadvantages singly or in any combination and solves at least the above mentioned problems, at least partly, by providing a multi-band antenna device for use in a radio communication terminal, and a radio communication terminal comprising such an antenna device, according to the appended patent claims.

Hence, it is an object of the present invention to provide an alternative antenna structure suitable for built-in antennas, at the same time having a wide bandwidth, which enables the antenna to be operable at a plurality of frequency bands, and having a high efficiency.

More specifically, it is an object of the invention to provide an antenna with high-gain at high-band, which is both small and has good performance not only in a low frequency band, such as the 900 MHz GSM band, but also good performance in several higher frequency bands, such as the 1800 MHz GSM or DCS band, the 1900 MHz GSM or PCS band, and the 2.1 GHz UMTS band.

A further object of the present invention is to provide an antenna capable of operating efficiently in both the 850 and 900 MHz bands (GSM and EGSM).

Yet a further object of the invention is to provide an antenna element having a minimal number of contacts.

According to a first aspect of the invention, at least one of these objects is fulfilled alone or in combination with other objects by a multi-band radio antenna device for a radio communication terminal, comprising a substrate, and a radiating antenna element thereon having a radio signal feeding point, said radiating antenna element comprising a first radiating portion resonant at a first frequency band and a second, higher frequency band, said first radiating portion comprising an elongate substantially straight radiating portion arranged proximal to and connected to said signal feeding point and an at least partly tightly meandered radiating portion arranged distal from said radio signal feeding point; and a second radiating portion connected as a branch to said first radiating portion at a bifurcation position thereof arranged distal from said radio signal feeding point and configured to tune said second frequency resonance of said first radiating portion in use of said antenna device to a frequency band that is lower than said second frequency band.

The first radiating portion, the second radiating portion, and the radio signal feeding point of the multi-band radio antenna device may be made of one integral continuous trace of electrical conducting material on the substrate.

The substrate of the multi-band radio antenna device may be a flexible film.

The multi-band radio antenna device may be arranged on a support element configured to be mounted within a casing of a radio communication terminal.

The second radiating portion may be arranged adjacent to or slightly separated from said tightly meandered radiating portion.

The elongate radiating portion of the multi-band radio antenna device may compose approximately ⅓ to ½ of the total length of the multi-band radio antenna device.

The tightly meandered radiating portion of the multi-band radio antenna device may be electrically longer than said elongate radiating portion and said meandered radiating portion may be configured to contribute to a first resonance of the antenna device, wherein the first resonance is a ¼ wave resonance to which said meandered radiating portion and said elongate radiating portion are configured to contribute at a given first radio frequency.

The second radiating portion of the multi-band radio antenna device may be shorter than said meandered radiating portion and configured to contribute to tune a second resonance, at a higher frequency than said first frequency, wherein the second resonance is a higher order resonance which in use of the antenna device forms on a electrically longer element comprising both said second radiating portion and said tightly meandered radiating portion.

The second radiating portion of the multi-band radio antenna device may be a tuning element arranged as a branch that is configured to electrically couple to the elongate radiating portion, wherein said tuning element is further configured to change the impedance of the second resonance on the antenna.

A matching circuit may be applied between the radio signal feeding point and the antenna, wherein said matching circuit is configured to perform an impedance transformation to at least one of the resonances created by the antenna.

The continuous trace of conductive material of the multi-band radio antenna device may be made by photo-etching or photo-deposition, wherein the multi-band radio antenna device may be arranged on a curved surface.

The multi-band radio antenna device may comprise an additional branch configured to couple to the second radiating portion to shift the impedance of a second resonance frequency of said multi-band radio antenna device.

The additional branch may be configured to improve the bandwidth of said second resonance frequency of said multi-band radio antenna device).

The multi-band radio antenna device may further comprise a ground connection configured to limit impedance shift of the multi-band radio antenna device in multiple operating positions thereof.

The multi-band radio antenna device may comprise at least one matching element in order to improve the impedance of a lower resonance frequency of said multi-band radio antenna device.

According to another aspect of the invention, a radio communication terminal is provided, which comprises the multi-band radio antenna device according to a first aspect of the invention. According to one embodiment, the radio communication terminal is a mobile telephone that comprises such a multi-band radio antenna device for RF communication purposes.

According to another aspect of the invention, a method of tuning multi-band radio antenna device of a radio communication terminal is provided, wherein the antenna device comprises a substrate, and a radiating antenna element thereon having a radio signal feeding point, and said radiating antenna element comprises a first radiating portion resonant at a first frequency band and a second, higher frequency band, said first radiating portion comprising an elongate substantially straight radiating portion arranged proximal to and connected to said signal feeding point and an at least partly tightly meandered radiating portion arranged distal from said radio signal feeding point, and a second radiating portion connected as a branch to said first radiating portion at a bifurcation position thereof arranged distal from said radio signal feeding point. The method comprises tuning said second frequency resonance of said first radiating portion in use of said antenna device to a frequency band that is lower than said second frequency band by said second radiating portion.

The said tuning may comprise exclusively tuning the second, higher frequency resonance created on the first radiating antenna element by said second radiating portion, without creating a further resonance on said antenna device.

The tuning may comprise locating said second radiating portion sufficiently far from said radio signal feeding point that it forms a non-radiating radiating element, and serves to tune at least one higher order resonance of the first radiating portion to a lower frequency band.

The tuning may comprise in operation creating a current null between said signal feeding point and said second radiating portion when said antenna device is operational in the second, higher frequency band.

The tuning may comprise providing said first radiating portion longer than said second radiating portion with a tight meander at the end thereof and little or no meander at said elongate radiating portion for lowering higher order resonance frequencies, and further lowering this higher order resonance frequency by means of said second radiating portion branching from said feeding point.

The method may comprise providing said second radiating portion shorter than said meandered radiating portion and contributing to a second resonance of the antenna device, at a higher frequency than said first frequency, with said second radiating portion, wherein the second resonance is a higher order resonance which in use of the antenna device is forming an electrically longer element comprising both said second radiating portion and said tightly meandered radiating portion.

The method may comprise providing said second radiating portion as a tuning element arranged as a branch that is electrically coupling to the elongate radiating portion, wherein said tuning element is further changing the impedance of the second resonance on the antenna.

The method may comprise providing the multi-band radio antenna device with an additional branch, and coupling the additional branch to the second radiating portion for shifting the impedance of a second resonance frequency of said multi-band radio antenna device.

The additional branch may improve the bandwidth of said second resonance frequency of said multi-band radio antenna device.

The method may comprise providing the multi-band radio antenna device with a ground connection for limiting impedance shift of the multi-band radio antenna device in multiple operating positions thereof.

The method may comprise providing the multi-band radio antenna device with at least one matching element for improving the impedance of a lower resonance frequency of said multi-band radio antenna device.

According to yet a further aspect of the invention, a manufacturing process is provided. The manufacturing process is a process for manufacturing a multi-band radio antenna device according to the above aspect of the invention and comprises photo-etching, photo-depositing, precision stamping or insert molding a continuous trace of conductive material of said device onto a substrate thereof.

The manufacturing process may comprises arranging said continuous trace on a flexible film during said process.

The manufacturing process may comprise arranging said multi-band radio antenna device on a support element and mounting said support element within a casing of said radio communication terminal.

The manufacturing process may comprise arranging said antenna device on a curved surface.

The present invention has at least the advantage over the prior art that it for instance offers a minimized number of necessary contacts and improved antenna efficiency.

The term "flat" used in the context of this specification, when describing the invention, is "having little depth or thickness". Hence, the term "flat" is not necessarily synonym with "planar", but does not exclude a planar arrangement of the "flat" element. To the contrary, a "flat" element may be arranged in a three-dimensional curved plane or in a planar plane.

BRIEF DESCRIPTION OF THE DRAWINGS

These and other aspects, features and advantages of which the invention is capable of will be apparent and elucidated from the following description of embodiments of the present invention, reference being made to the accompanying drawings, in which.

DESCRIPTION OF EMBODIMENTS

Figure 1:
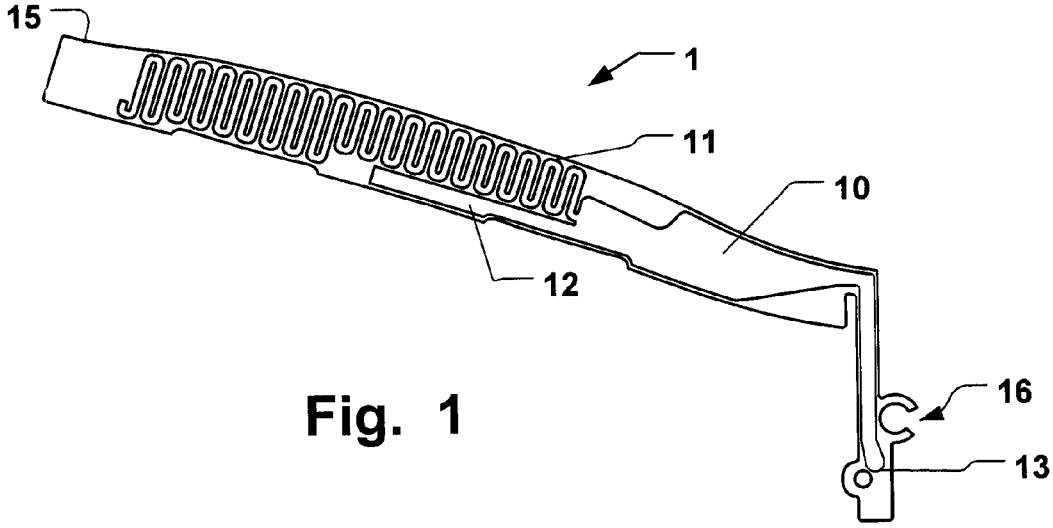
FIG. 1 is a schematic illustration of a multi-band radio antenna device according to an embodiment of the invention.

It will be understood that the Figures, illustrating embodiment of the invention, are merely schematic and are not drawn to scale. For clarity of illustration, certain dimensions may have been exaggerated while other dimensions may have been reduced. Also, where appropriate, the same reference numerals and letters are used throughout the Figures to indicate the same parts and dimensions.

The following description focuses on embodiment of the present invention applicable to a mobile telephone. However, it will be appreciated that the invention is not limited to this application but may be applied to many other mobile communication terminals in which to implement a radio antenna design according to the present invention, including the following examples. The terms mobile or radio communication terminal comprises all mobile equipment devised for radio communication with a radio station, which radio station also may be mobile terminal or e.g. a stationary base station. Consequently, the term mobile communication terminal includes mobile telephones, pagers, communicators, electronic organizers, smartphones, PDA:s (Personal Digital Assistants), vehicle-mounted radio communication devices, or the like, as well as portable laptop computers devised for wireless communication in e.g. a WLAN (Wireless Local Area Network). Furthermore, since the antenna as such is suitable for but not restricted to mobile use, the term mobile communication terminal should also be understood as to include any stationary device arranged for radio communication, such as e.g. desktop computers, printers, fax machines and so on, devised to operate with radio communication with each other or some other radio station. Hence, although the structure and characteristics of the antenna design according to the invention is mainly described herein, by way of example, in the implementation in a mobile phone, this is not to be interpreted as excluding the implementation of the inventive antenna design in other types of mobile communication terminals, such as those listed above.

Several of the larger mobile phone manufacturers, e.g. Motorola® and Nokia®, have launched mobile phones for cellular communication networks and implementing built-in antennas for both dual band, or triple band operation. The following embodiments of the inventive antenna provide in addition at least quad band operation of such mobile phones.

More precisely, an antenna concept or design is described herein, comprising the structure of the antenna, its performance, and its implementation in a radio communication terminal, with reference to the accompanying drawings.

Figure 2:
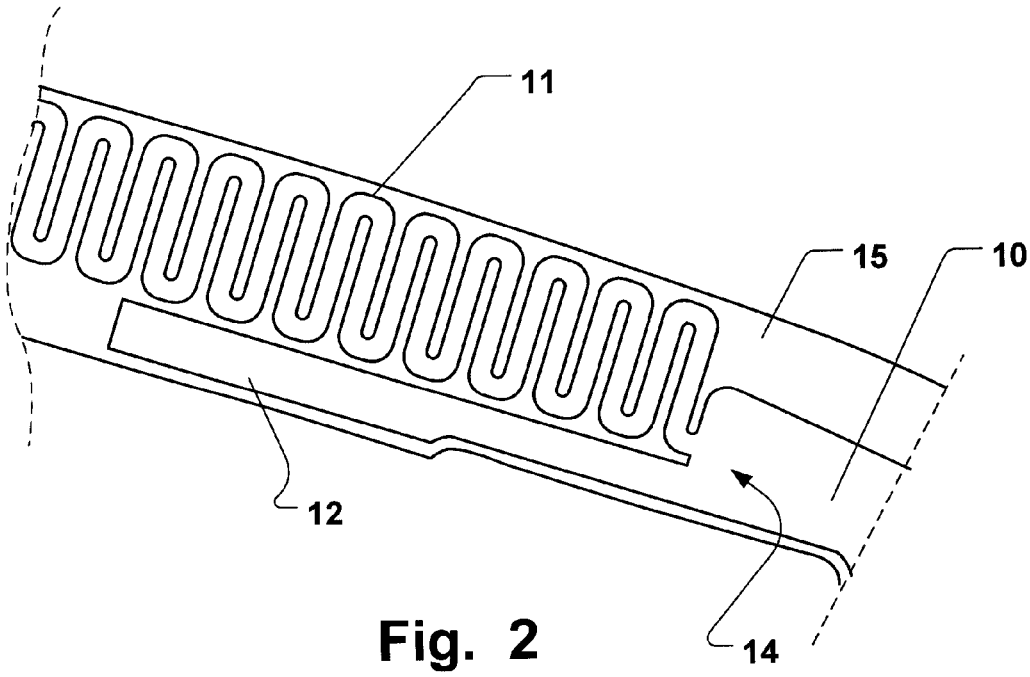
FIG. 2 shows an enlarged portion of the multi-band radio antenna device shown in FIG. 1.

In an embodiment of the invention according to FIG. 1 a multi-band radio antenna device 1 is shown, which has the following elements: an elongate radiating portion 10, composing approximately ⅓ of the antennas length; a branched section, branching at a bifurcation 14, which has an electrically longer element in the form of a tightly meandered radiating portion 11 that contributes to a ¼ wave resonance at a given frequency, and a second, shorter radiating portion 12, which is used to tune a higher resonance which forms a ½ wave resonance on the device 1. FIG. 2 illustrates the region of the bifurcation 14 in an enlarged view. However, other embodiments may have a variant of the illustrated meandering portion having variable pitch. In addition, the meandering portion may also comprise substantially linear section(s). An example of an alternative embodiment is shown in FIG. 15.

Figure 15:
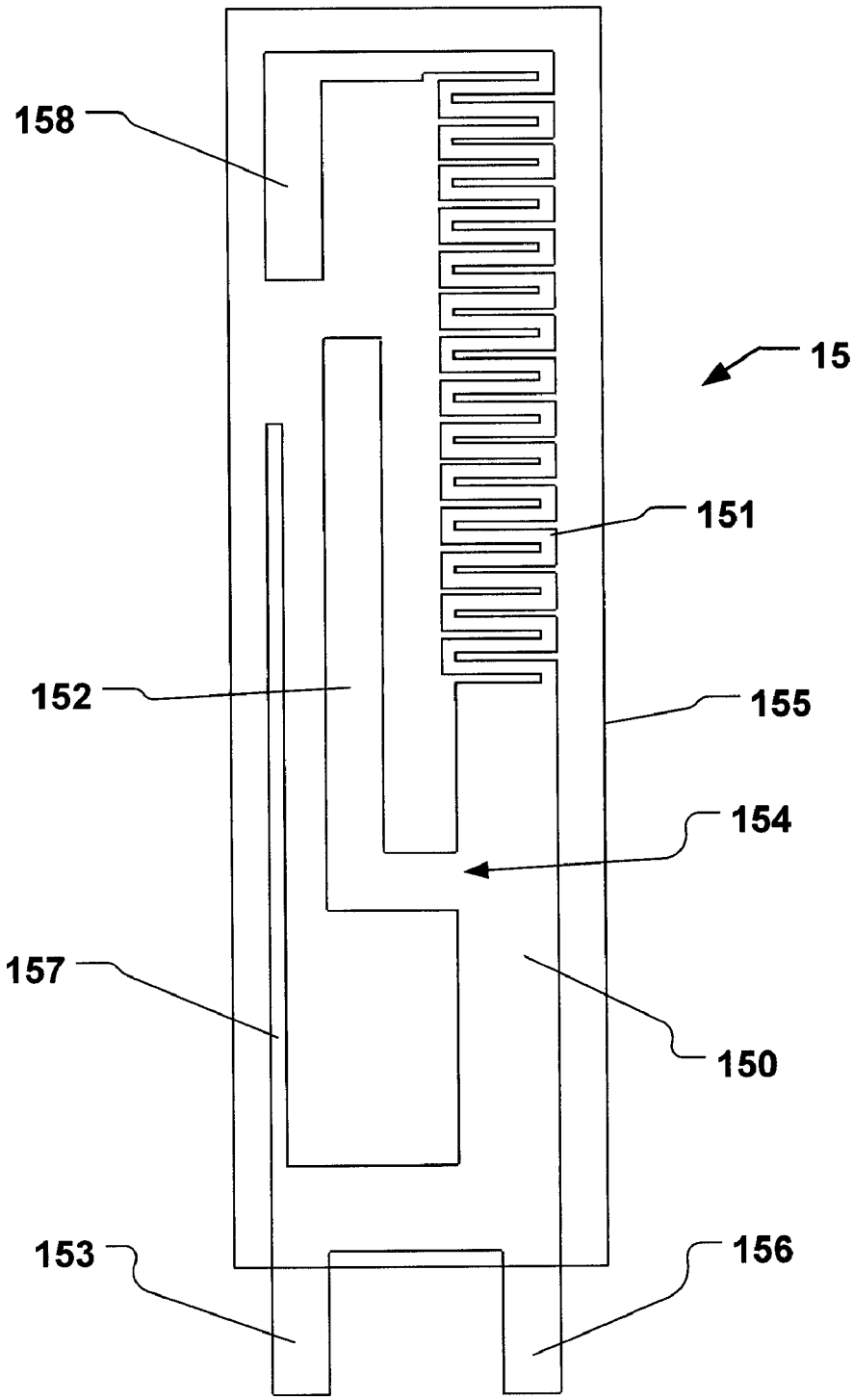
FIG. 15 is a schematic illustration of a multi-band radio antenna device according to another embodiment of the invention.

The antenna device shown in FIG. 15 is electrically similar to the one shown in FIG. 9, but in a substantially planar configuration, and is described in more detail below.

More precisely, the multi-band radio antenna device 1 is shown as a flex-design implementation. The longer element 11 has a meander form, and is in operation of the antenna used as a resonant element for a low frequency band, such as around 800 MHz. The shorter branch 12 is in operation of the antenna, when fed with a radio frequency signal via a connecting feed at end 13, used to tune the higher resonance, such as around 1800 MHz. The second, shorter radiating portion 12 may be placed adjacent to the tightly meandered radiating portion 11, or slightly separated, e.g. on the other side of a carrier to which the substrate 15 is attached, for example made of a plastic material, which is described in more detail below. In fact, measurements have shown that slightly separating these branches 11, 12 has the effect of improving gain in some cases, though the material and/or assembly costs may increase. However, in some cases it might be advantageous to have such a separate arrangement, depending on various requirements, such as antenna performance versus implementing cost or design flexibility.

In even more detail, the antenna trace comprises a elongate radiating portion 10 of conductive material, which acts as a geometrically broad feeding strip of the antenna device 1, and is consequently adapted to communicate electrically with a radio circuitry of a radio communication terminal via a feeding at point 13, e.g. through an antenna connector. A fastening element 16 may be conveniently integrated with the device 10 for mechanically fixing the device 1 to a radio communication device. The elongate radiating portion 10 has an elongate extension, as shown in the FIG. 1, and it has along a major portion thereof a considerable width, in the range of several mm. However, the exact value of the width of the first conductive portion 10 must be chosen under due consideration of various design and tuning parameters, as is readily realized by one skilled in the art. The elongate radiating portion 10 (the broad feeding strip) will have high currents when operating in the lower (¼ wave) as well as the higher (½ wave) frequency modes of the antenna The electrically longer element, in the form of the tightly meandered radiating portion 11 of the continuous antenna trace in connection with the elongated radiating portion 10 will act as the primary radiator for the low frequency band(s), such as GSM 850 and/or EGSM 900. As shown in FIGS. 1 and 2, the meandered radiating portion 11 is twisted in a meander shape and has a considerably smaller (narrower) width than the elongate radiating portion 10, for instance with a factor 1:10.

The shape of the tightly meandered radiating portion 11 is important because the tight meander serves to lower the resonance frequency of the higher harmonic modes of the primary resonance such that they may be further tuned by the second radiating portion 12 to operate in the frequency band of interests. For this present embodiment, this band of interest is the DCS and/or PCS bands, though in other cases it may also include the UMTS bands or other frequency bands.

A typical electrical length of the entire antenna 1, when radiating at the EGSM band (900 MHz) will be lambda/4, where lambda is the wavelength in the radiating material. Because plastics surround the radiating element, the effective wavelength is considerably shorter than the approximately 33.3 cm wavelength of freespace. In any case, as is typical with resonating structures, higher order harmonics form. In the case of this structure, odd order harmonics form (lambda/4, 3*lambda/4, 5*lambda/4, etc). These would typically radiate at, for example 900 MHz, 2.7 GHz, 4.5 GHz, etc. However, as previously stated, the meander section 11 at the end of the radiating element tends to lower the resonance of the harmonics more than that of the primary resonance. This is because the e-fields for the primary resonating frequency are so high near the end of the element compared with the spacing of the meander that the meander appears somewhat "invisible" to the said frequency when operating in the primary frequency mode. However, in higher operating modes, this meander is seen and contributes accordingly to lowering the resonance frequency. Accordingly, the $3^{rd}$ harmonic mode is lowered in frequency to, for example, 2.2 GHz from 2.7 GHz. The additional branch, in the form of the second radiating portion 12 serves to add additional tuning length to this resonance to further lower the resonance frequency, for example, from 2.2 GHz to 1.7 GHz.

The conductive antenna trace is attached to a flat support element 15, such as in the form of a dielectric film, e.g. made of polyimide, polyamide or polyester. For instance a dielectric film having a thickness of 0.1 mm and being commercially available from 3M Corporation, or a similar dielectric film may be used. The trace 1 of conductive material and the dielectric film together form a flex film, which advantageously has an adhesive film attached to its underside for easy assembly to a radio communication terminal. Alternatively, multi-band radio antenna device according to certain embodiments may be made by directly photo-etching the continuous trace of the antenna device onto a suitable substrate, e.g. a constructive element of a radio communication terminal, such as its housing or a carrier inside such a housing. A further manufacturing alternative is to use a photo-deposition technique for manufacturing the continuous trace. These techniques, as well as the flexible film, allow to provide the inventive antenna device on curved surfaces. Precision stamping and insert molding techniques may also be used for manufacturing the type of antenna device described herein.

Figure 3:
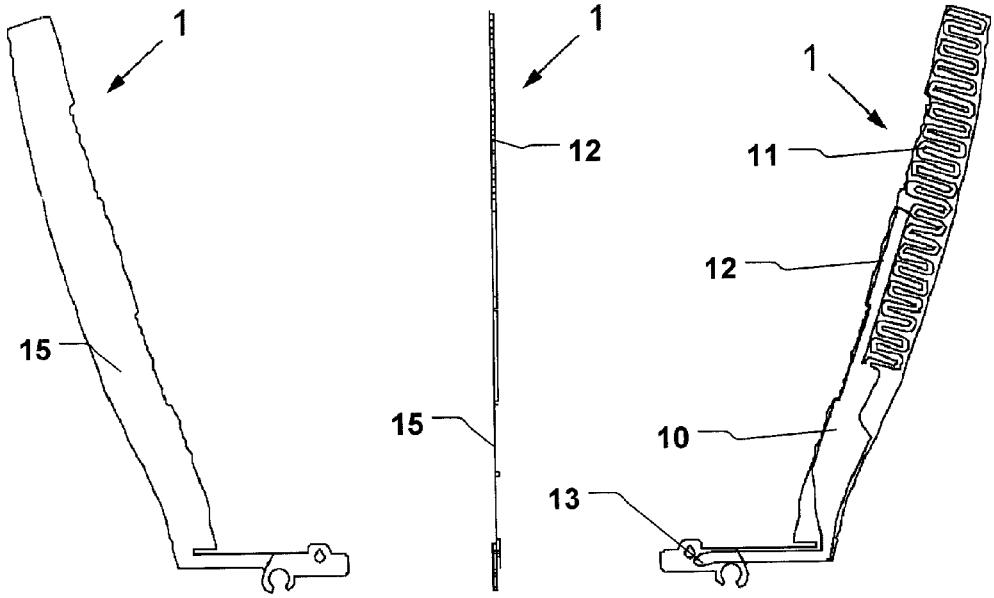
FIG. 3 is a schematic illustration of the multi-band radio antenna device of FIG. 1 further showing the back and a cross-section of the device.

FIG. 3 illustrates the element of FIG. 1 in a top view (shown on the right), in a cross-sectional view (shown in the middle) and a bottom view (shown on the left), further illustrating that the antenna device may be extremely thin. The embodiment shown is arranged on a carrier 15, which in the present case is a flexible film. The antenna elements 10, 11, 12 are made of a thin trace of a conductive material, such as copper. The assembly of the film and antenna trace may also have an adhesive tape at its underside, so that it may conveniently, fast and efficiently be attached to a carrier element of a radio communication terminal, such as a mobile telephone. Examples for such mountings are given below with reference to FIGS. 11-12.

Voltage Standing Wave Ratio (VSWR) relates to the impedance match of an antenna feed point with a feed line or transmission line of a radio communications device. To radiate radio frequency (RF) energy with minimum loss, or to pass along received RF energy to a RF receiver of a radio communication terminal with minimum loss, the impedance of an antenna should be matched to the impedance of a transmission line or the impedance of the feed point.

Figure 4A:
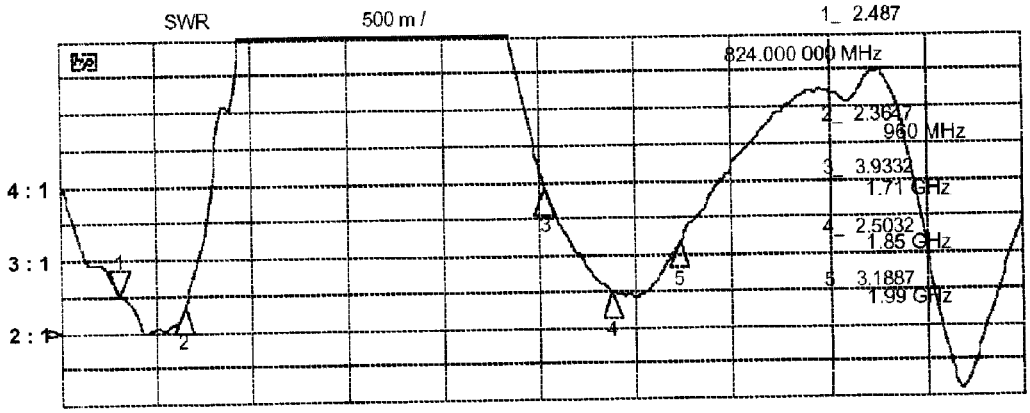
FIG. 4A illustrates the voltage standing wave ratio (VSWR) characteristics for the multi-band radio antenna device of FIG. 1.
Figure 4B:
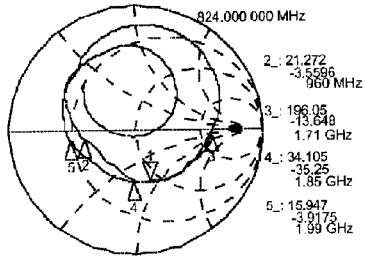
FIG. 4B is a Smith diagram showing the impedance characteristics for the multi-band radio antenna device of FIG. 1.

The Voltage Standing Wave Ratio (VSWR) of the antenna device 1 is shown in FIG. 4A. Note that the scale on all VSWR charts shown is 0.5 per division, rather than the 1 per division, which is commonly used, in order to show additional resolution. From the VSWR diagram it is noted that the band-edge VSWR in the high-band is about 3.5:1, with 2.5:1 in the center of the resonance (1850 MHz). In order to minimize return loss, it is necessary to have the antenna matched properly to the driving source. The power amplifier circuitry used in mobile phones is commonly designed to be most efficient near the 50 Ohm point. Thus, it is often desirable to design the antenna with a VSWR of lower than 2:1 to minimize return loss. Depending on the efficiency of the antenna, the design of the PA, etc., slightly higher VSWRs may also be acceptable in certain cases With this design, it was found that the antenna efficiency was so high that slightly high VSWR values (such as 3:1) still provided better overall efficiency than other designs with lower VSWRs. FIG. 4B shows a Smith diagram showing the impedance characteristics for the multi-band radio antenna device of FIG. 1.

It is noted that the diagram shows a good matching of the antenna to 50 Ohms at the frequency bands of interest, which implies a good efficiency of the antenna device 1. Chamber measurements confirm high efficiencies.

Figure 8A:
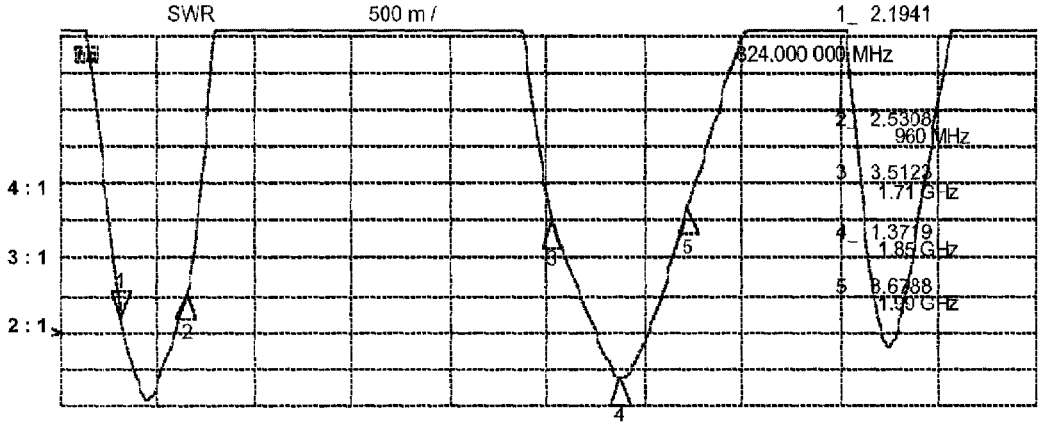
FIG. 8A illustrates the VSWR characteristics for the multi-band radio antenna device of FIG. 1 operated with the circuit of FIG. 7.
Figure 8B:
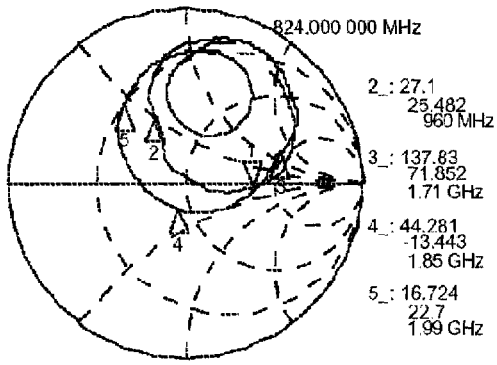
FIG. 8B is a Smith diagram showing the impedance characteristics for the multi-band radio antenna device of FIG. 1 operated with the circuit of FIG. 7.
Figure 10A:
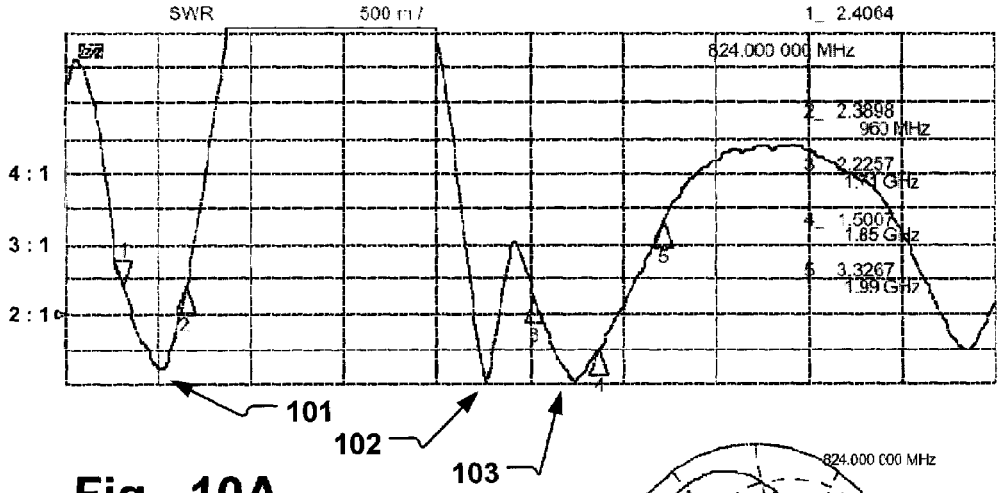
FIG. 10A illustrates the VSWR characteristics for the multi-band radio antenna device of FIG. 9.
Figure 10B:
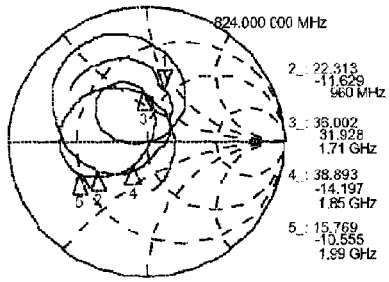
FIG. 10B is a Smith diagram showing the impedance characteristics for the multi-band radio antenna device of FIG. 9.

Smith diagrams, such as shown in FIGS. 4B, 8B and 10B, are a familiar tool within the art and are thoroughly described in the literature, for instance in chapters 2.2 and 2.3 of "Microwave Transistor Amplifiers, Analysis and Design", by Guillermo Gonzales, Ph.D., Prentice-Hall, Inc., Englewood Cliffs, N.J. 07632, USA, ISBN 0-13-581646-7. Reference is also made to "Antenna Theory Analysis and Design", Balanis Constantine, John Wiley & Sons Inc., ISBN 0471606391, pages 43-46, 57-59. Both of these books are fully incorporated in herein by reference. Therefore, the nature of Smith diagrams is not penetrated in any detail herein. However, briefly speaking, the Smith diagrams in this specification illustrate the input impedance of the antenna: $Z=R+jX$, where R represents the resistance and X represents the reactance. If the reactance $X>0$, it is referred to as inductance, otherwise capacitance.

In the Smith diagram the curved graph represents different frequencies in an increasing sequence. The horizontal axis of the diagram represents pure resistance (no reactance). Of particular importance is the point at 50 Ohms, which normally represents an ideal input impedance. The upper hemisphere of the Smith diagram is referred to as the inductive hemisphere. Correspondingly, the lower hemisphere is referred to as the capacitive hemisphere.

Figure 5A:
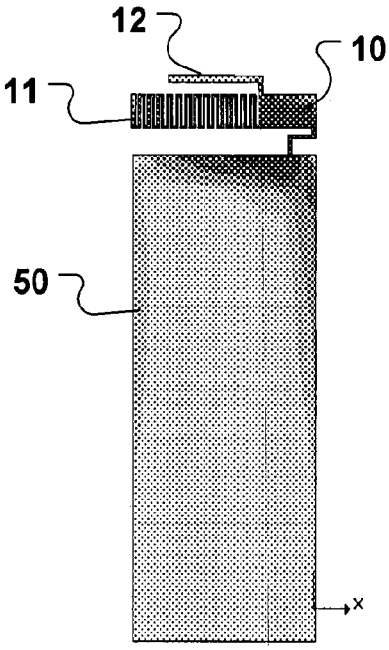
FIGS. 5A and 5B are schematic illustrations of the current distribution of a multi-band radio antenna device of the type shown in FIG. 1 with a ground plane, at different simulated operating frequencies respectively.
Figure 5B:
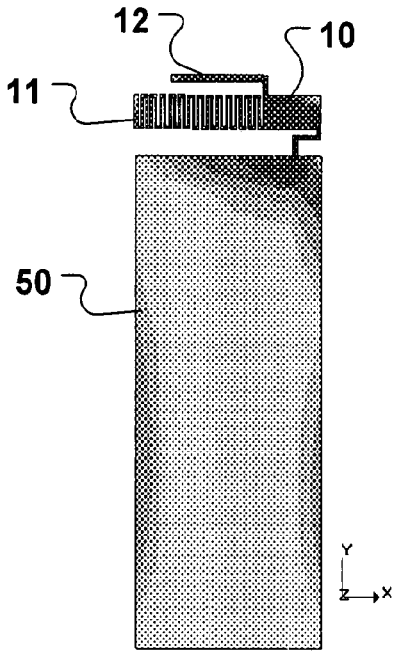

FIGS. 5A and 5B are schematic illustrations of the current distribution of a multi-band radio antenna device of the type shown in FIG. 1 with a ground plane 50, at different simulated operating frequencies respectively.

Figure 6:
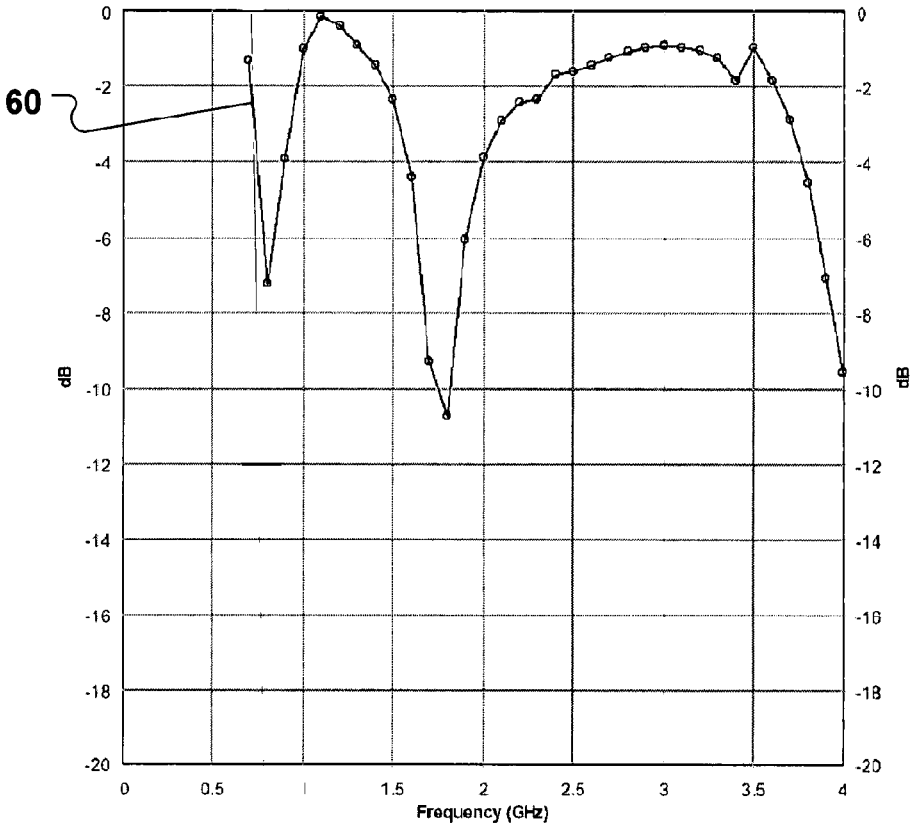
FIG. 6 illustrates the return loss of the a multi-band radio antenna device shown in FIGS. 5A and 5B.

FIG. 6 illustrates the return loss 60 of the multi-band radio antenna device shown in FIGS. 5A and 5B. FIG. 5A shows the current densities typical of a ¼-wave mode i.e. high current density at the feed point decreasing as at it gets to the end of the element. In contrast, FIG. 5B shows very high current by the feed followed by a current null, followed by another high current section in the middle of the meander and another current null at the end of the element. The current null created near the feed point indicates that this element is operating in the 3rd harmonic mode, which in this case has been tuned such that it occurs at a frequency approximately 2× the primary operating frequency of the antenna.

The simulation indicates the tuning trends of this tuning element 12, 92, which has further been verified with experimental data (FIGS. 4, 8, 10).

Figure 7:
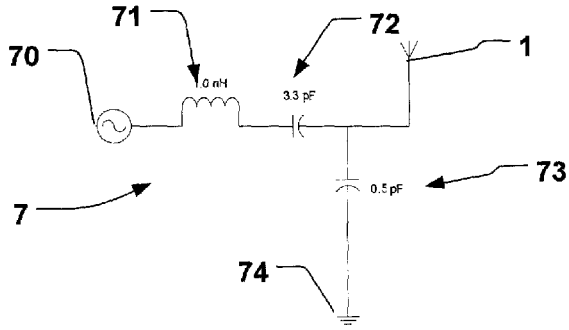
FIG. 7 shows a schematic circuit diagram for further improving the characteristics of the a multi-band radio antenna device of FIG. 1 in use thereof.

In addition to the above, the antenna device 1 may also be combined with a matching circuit 7 according to another embodiment, as illustrated in FIG. 7. This circuit may improve the matching of the antenna 1, which in turn improves gain, etc. A sample matching circuit, which was used and tested on a mobile phone, is as illustrated with reference to FIG. 7. The antenna 1 is fed from a RF-source 70 via an impedance 71 and a capacitor 72, and connected to ground 74 via a capacitor 73.

FIG. 8A illustrates the VSWR characteristics for the multi-band radio antenna device of FIG. 1 operated with the circuit of FIG. 7.

FIG. 8B is a Smith diagram showing the impedance characteristics for the multi-band radio antenna device of FIG. 1 operated with the circuit of FIG. 7.

With the matching circuit 7 in place, the band-edge VSWR is similar, but the VSWR in the center of the band is significantly improved to about 1.4:1. An improvement was noted in PCS TX of about 2 dB and an improvement in DCS of about 0.5 dB. Low-band performance may decrease in this case by about 0.5 dB relative to not having the match. This matching type may work generally for bent monopole configurations where this type of antenna is employed.

Additional or alternative matching configurations may also be used, as is well known to those skilled in the art.

Figure 11A:
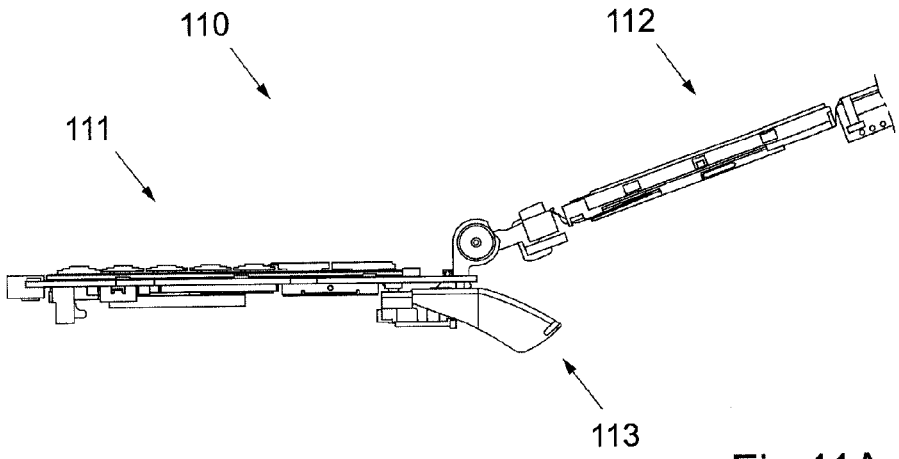
FIGS. 11A to 11C, 13A to 13D and 14 are schematic illustrations of a mobile radio communication terminal according to an embodiment of the invention comprising a multi-band radio antenna device.

A further embodiment of the invention is now described with reference to FIG. 9. A multi-band radio antenna device 9 comprises a third branch in the form of a tuning element 97, which couples to the second branch, i.e. the second radiating portion 92. The second radiating portion 92 extends in this case from the meander of the meandered radiating portion 91, branching at a bifurcation 94, and not directly from the elongate radiating portion 90, in contrast to the embodiment of FIG. 1. The antenna 9 is in operation, when assembled in a radio communication terminal, connected to RF-circuitry (not shown) via a single feeding point 93 feeding both portion 90, 91, 92 and tuning element 97. The embodiment shown in FIG. 9 has additionally a ground connection 96 in order to further improve performance of the antenna device 9. When the antenna device 9 is placed in the center of a radio communication device, as shown in FIGS. 11A and 11B, it is advantageous to add the ground connection to improve performance and limit e.g. impedance shifts between the open and closed states of the device. However, this means that no additional connection point is needed for certain embodiments of the invention, which do not have such an optional ground connection. In order to achieve best impedance matching the ground connection 96 may comprise matching elements, such as series inductance in order to improve especially the bandwidth or the impedance of the lower frequency 101.

The antenna 9, like antenna 1, consists of a continuous trace of electrically conductive material, preferably copper or another suitable metal with very good conductive properties. The conductive material may be thin, about 30-35 μm as in this example; consequently the thickness of the antennas has been highly exaggerated in the drawings for illustrating purposes only. An antenna connector serves to connect the antenna 9 to radio circuitry, e.g. provided on a printed circuit board in a mobile telephone 110. The antenna connector is only schematically indicated in the Figures. It may be implemented by any of a plurality of commercially available antenna connectors, such as a leaf-spring connector or a pogo-pin connector.

Moreover, the radio circuitry as such forms no essential part of the present invention and is therefore not described in more detail herein. As will be readily realized by one skilled in the art, the radio circuitry will comprise various known HF (high frequency) and baseband components suitable for receiving a radio frequency (HF) signal, filtering the received signal, demodulating the received signal into a baseband signal, filtering the baseband signal further, converting the baseband signal to digital form, applying digital signal processing to the digitalized baseband signal (including channel and speech decoding), etc. Conversely, the HF and baseband components of the radio circuitry will be capable of applying speech and channel encoding to a signal to be transmitted, modulating it onto a carrier wave signal, supplying the resulting HF signal to the antenna 1 or 9, etc.

Figure 11C:
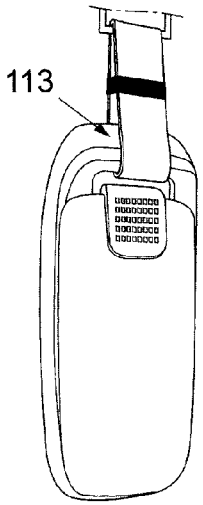
Figure 11B:
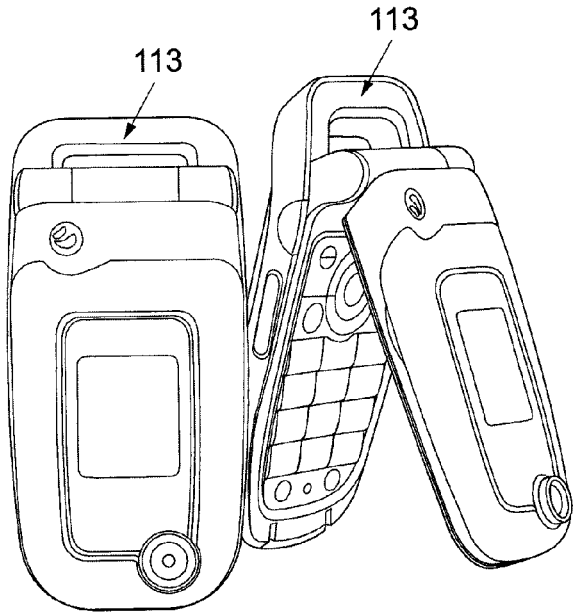

Unlike the previous configuration, shown in FIG. 1, in this case the antenna is for instance positioned in the center of a mobile telephone, in a so-called clamshell concept, shown in FIGS. 11A to 11C. While this pattern is shown in the flat state, in the assembled state the antenna is folded over a carrier 113 and appears as shown in FIGS. 9A, 9B, 10 and 11.

FIGS. 13A to 13D and 14 show alternative constructional designs of a carrier 113 having an antenna device, such as device 1 or 9, arranged thereon. Alternatively, which is not illustrated in the Figures, the multi-band antenna device according to the invention may be assembled inside a housing of a radio communication terminal, without a distinct carrier element identifiable from the outside of the housing. However, in the cases shown in the Figures, the carrier with the integrated antenna device may with advantage be combined with further functions, such as a strap holder, as shown in FIG. 11C.

With reference to FIGS. 10A and 10B, portions 90 and 91 (the elongate radiating portion 90 and the tightly meandered radiating portion 91) are configured and used to tune the first resonance frequency indicated at 101; portion 97, the tuning element, is configured and used to tune the second resonance frequency 102. The second radiating portion 92 is used in conjunction with the meandered radiating portion 91 to tune the third resonance frequency 103. Resonance 102 is tuned adjacent to resonance 103, but remains outside of the operational bandwidth of the antenna (i.e. lower than 1710 MHz) in order for the antenna to function with the best possible efficiency.

One can note in these figures that the separation between the third branch, the tuning element 97 and second branch, the second radiating portion 92, is very small, such as only about 1-2 mm, when the antenna device 9 is assembled on a carrier. Therefore there is significant capacitive coupling between the branches. This coupling serves to increase the bandwidth of the high-band which is tuned by the second radiating portion 92 by a factor of about 1.5 times. This third branch, tuning element 97, also forms a resonance 102, which is tuned slightly below the highband resonance for optimal gain and bandwidth. However, this resonance is a ¼ wave resonance rather than a ½ wave resonance and is not as efficient as the ½ wave resonance formed on the meander section of the antenna. For that reason, the third branch is tuned below the operating bandwidth for the antenna. In this way, it improves the bandwidth of the highband at resonance frequency 103 without negatively impacting performance of the antenna device 9.

Figure 9:
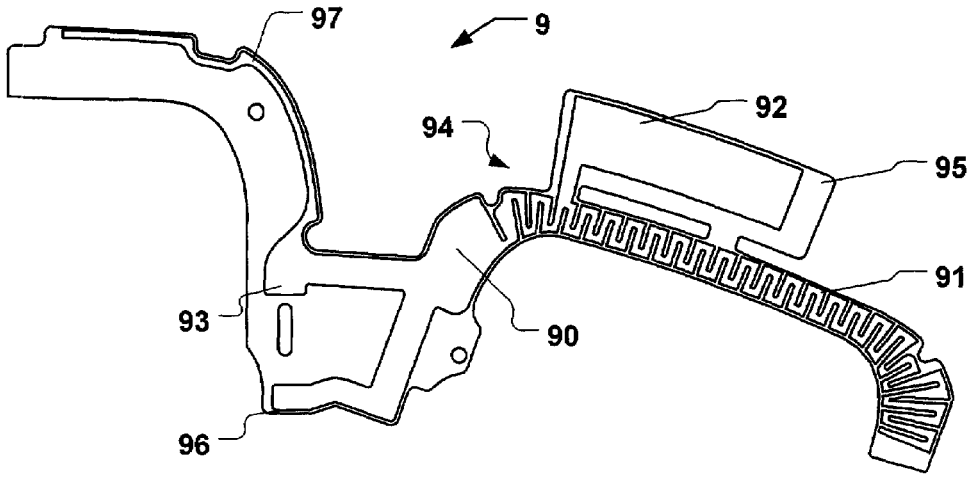
FIG. 9 is a schematic illustration of a multi-band radio antenna device according to a further embodiment of the invention.

A schematic illustration of the VSWR achieved with multi-band radio antenna device 9 is shown in FIG. 10A, showing the VSWR characteristics for the multi-band radio antenna device 9 of FIG. 9.

FIG. 10B is a Smith diagram showing the impedance characteristics for the multi-band radio antenna device of FIG. 9.

In this configuration, a third branch, tuning element 97, couples to the second branch, i.e. the second radiating portion 92, and has the effect of improving the matching of the high-band resonance.

FIG. 15 is a schematic illustration of a multi-band radio antenna device according to another embodiment of the invention. The antenna device 15 shown in FIG. 15 is electrically similar to the one shown in FIG. 9, but in a substantially planar configuration on a printed circuit board (PCB) 155.

The feed of device 15 is connected to the lower left corner 153 and the ground to the lower right corner 156. The two extensions on the lower side of PCB 155 would normally be folded down to contact to the PCB 155. The multi-band radio antenna device 15 comprises a third branch in the form of a tuning element 157, which couples to the second branch, i.e. the second radiating portion 152. The second radiating portion 152 extends, branching at a bifurcation 154, from the elongate radiating portion 150. The antenna 15 is in operation, when assembled in a radio communication terminal, connected to RF-circuitry (not shown) via a single feeding point 153 feeding both portion 150, 151, 152 and tuning element 157. The embodiment shown in FIG. 15 has additionally a ground connection 156, similar to the embodiment of FIG. 9. The antenna 15, like antenna 1 or 9, consists of a continuous trace of electrically conductive material. In addition, the end portion of meandering radiating portion 151 shows an end radiating portion 158 having a different pitch. End radiating portion 158 of this embodiment serves the purpose of further tuning the performance of device 15, and giving more design flexibility to the manufacturer of such devices.

A benefit of the invention is that it improves antenna performance significantly compared with other known antenna designs. For the design studied above, the high-bands achieved with this concept are about 1-2 dB better than those achieved through other known concepts. With this solution, the performance is substantially improved. In addition, only one or two contacts are used respectively for the antenna systems. Most competing commercially available concepts use two or three contacts. Because contacts are costly, occupy additional space, and are prone to failure, the elimination of additional contacts is an advantage provided by the invention.

FIG. 11 illustrates a radio communication terminal in the embodiment of a cellular mobile phone 110 devised for multi-band radio communication. The terminal 110 comprises a chassis or housing, carrying a user audio input in the form of a microphone and a user audio output in the form of a loudspeaker or a connector to an ear piece (not shown). A set of keys, buttons or the like constitutes a data input interface is usable e.g. for dialing, according to the established art. A data output interface comprising a display is further included, devised to display communication information, address list etc in a manner well known to the skilled person. The radio communication terminal 110 includes radio transmission and reception electronics (not shown), and is devised with a built-in antenna device 113 inside the housing. FIG. 11 shows the interior design of the terminal 110 without the housing.

Figure 12A:
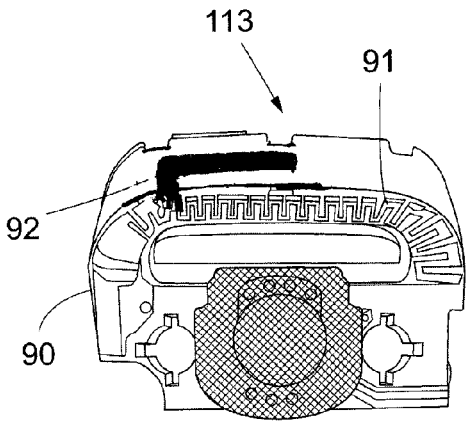
FIGS. 12A and 12B are illustrations of a multi-band radio antenna device according to an embodiment of the invention mounted on a carrier to be integrated with a mobile radio communication terminal.
Figure 12B:
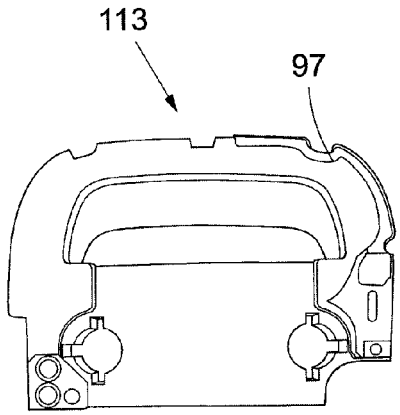
Figure 13A:
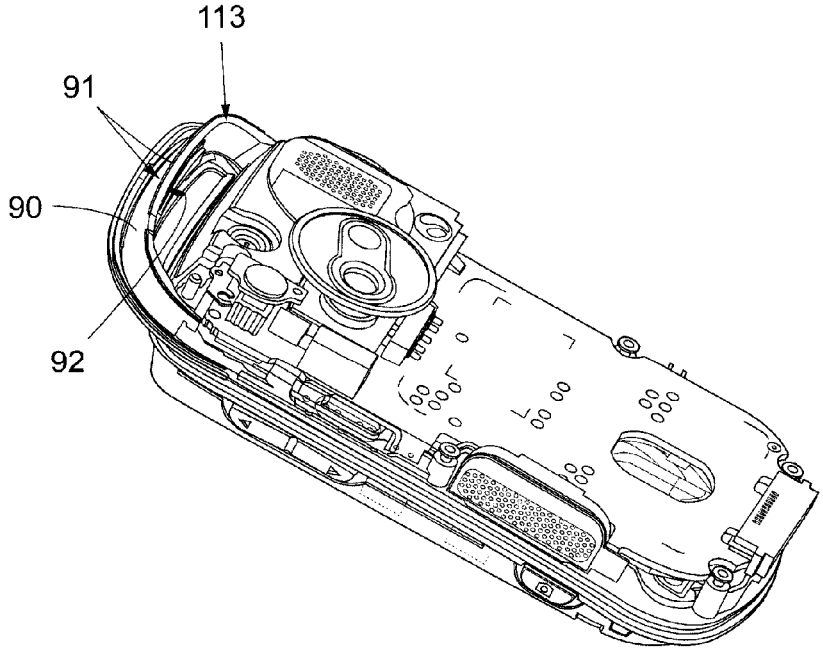
Figure 13B:
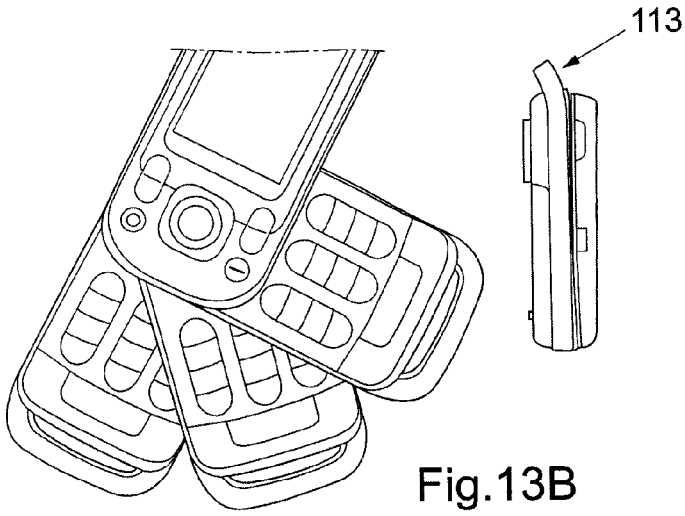
Figure 13C:
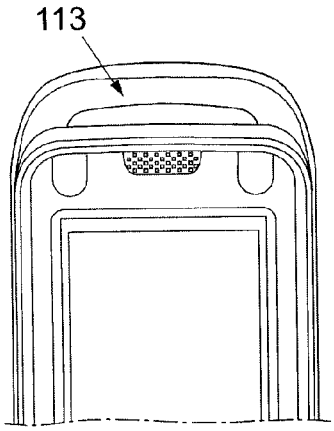
Figure 13D:
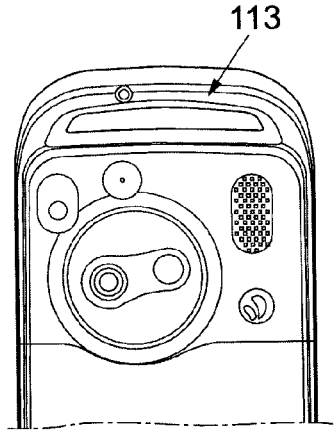
Figure 14:
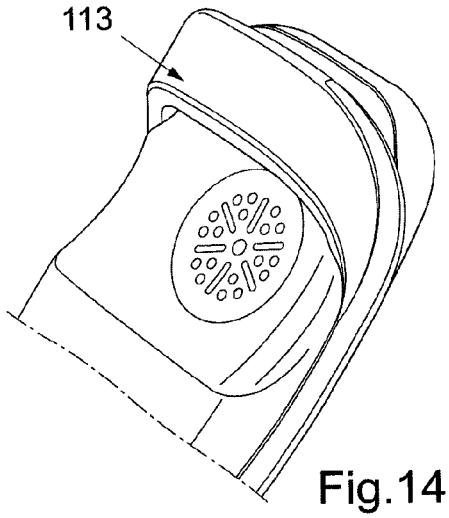

Antenna 113 is mounted to a carrier, which is shown in more detail in FIGS. 12 and 13. More precisely, the Figures illustrate a first antenna section 90, composing approximately ⅓ of the antennas length; a branched section, branching at a bifurcation, which has an electrically longer element 91 that contributes to a ¼ wave resonance at a given frequency, and a second shorter element 92, which is used to tune the higher resonance which forms a ½ wave resonance on the device 113. A tuning element 97 is attached to the back of the back of the carrier, shown in FIG. 12B.

In the following two tables, representative data is given for two implementation, "phone 1" and "phone 2", wherein measured freespace gain is given.

Table 1 gives the values for the phones using an antenna device according to the invention. Phone 1 has implemented the design according to FIG. 1, and Phone 2 has implemented the design according to FIGS. 9 and 12.

TABLE 1

| Phone | Form Factor | Freespace Gain, Open position 850/900 MHz | 1800 MHz | 1900 MHz |
|---|---|---|---|---|
| Phone 1 | Slider type phone | −2.2 dBi | −1.8 dBi | −1.1 dBi |
| Phone 2 | Clam type phone | −2.8 dBi | −3.1 dBi | −3.1 dBi |

Table 2 gives the data for the phones using previous antenna concepts.

TABLE 2

| Phone | Concept | Freespace Gain, Open position 850/900 MHz | 1800 MHz | 1900 MHz |
|---|---|---|---|---|
| Phone 1 | Floating parasitic, dual high-band | −2.5 | −4.2 | −3.5 |
| Phone 2 | Parasitic for second high-band | −2.8 dBi | −4.3 | −3.9 |

Conclusively, not only does the antenna according to the invention provide excellent performance in a low frequency band around 850 and 900 MHz (e.g. for GSM and EGSM) but also in different high frequency bands around 1800 MHz (e.g. DCS or GSM 1800 at 1710-1880 MHz), 1900 MHz (e.g. PCS or GSM 1900 at 1850-1990 MHz). In other words, the inventive antenna is a highly efficient multi-band antenna with very broad high frequency band coverage. As is well known to those skilled in the art, tuning branch 12 (and/or 92 and 97) may be shortened in order to shift the frequency of the high-band to make this invention perform in the UMTS ("Universal Mobile Telephone System") bands around 2100 MHZ, BT ("Bluetooth) bands around 2450 MHz, or other higher frequency operational bands.

In summary, the present invention offers the following advantages, alone or in combination.

An alternative antenna structure to known structures is provided that is suitable for built-in antennas, at the same time it has a wide bandwidth, which enables the antenna to be operable at a plurality of frequency bands, and has a high efficiency.

Furthermore, an antenna is provided with high-gain at high-band, which may be designed both small and in such a way that it has good performance not only in a low frequency band, such as the 900 MHz GSM band, but also good performance in several higher frequency bands, such as the 1800 MHz GSM or DCS band, the 1900 MHz GSM or PCS band, and the 2.1 GHz UMTS band.

The invention provides an advantageous antenna configuration having a ½ wave or near ½ wave antenna for the high bands, which minimizes the radio emissions towards the user of a device having the antenna integrated, i.e. performance in the talk position is improved.

Moreover, the present invention provides an antenna, which is capable of operating efficiently in both the 850 and 900 MHz bands (GSM and EGSM).

Further, an antenna is provided, which may be formed as a continuous trace of conductive material without requiring a separate parasitic element for impedance matching purposes.

The multi-band radio antenna is a compact antenna device, which may be disposed inside the casing of a mobile communication terminal in order to make the terminal compact and having a low weight.

Still another advantage is that an antenna element is provided having a satisfactory efficiency and bandwidth for each frequency in spite of a low volume of the device. The performance is at least as good as for a conventional PIFA antenna.

The invention enables manufacturers of mobile radio communication terminals to have a built-in antenna device, which may be manufactured in large series at low costs. Furthermore the present invention provides an antenna, which offers flexible positioning in a mobile radio terminal, e.g. the inventive antenna device may be provided on curved surfaces, even independent of the orientation of a ground element in relation to the curved surface.

The invention provides a substrate and a radiating antenna element thereon having a radio signal feeding point. The radiating element comprises a continuous trace of conductive material, wherein the continuous trace has a first radiating portion connected to the radio signal feeding point. The first radiating portion comprises an at least partly tight meandered radiating portion arranged distal from said radio signal feeding point and connected to an elongate radiating portion arranged proximal to and connected to the signal feeding point, and a second radiating portion connected as a branch to said first radiating portion at a branching position thereof arranged distal from said radio signal feeding point.

A longer branch with a very tight meander at the end is used in order to lower the higher order frequencies and then using an additional branch to further lower this higher order harmonic in order to get it to radiate in the above-specified specified high-band frequency range. In order to do this, the following conditions are necessary:

1) Tight meander at the end of the longer element.

2) Little or no meander at the beginning of the longer element.

3) Branching the shorter tuning element away from the feed point.

This has the effect of forcing a current null between the feed point and the shorter branched element.

This is achieved for instance by a multi-band radio antenna device comprising a) a substrate and b) a radiating antenna element comprising: i) a first radiating element resonant at a first frequency band consisting of a substantially strait portion proximal to the feed point and a tightly meandered section distal from the feed section; ii) a second tuning element connected to the first radiating element and located distally from the feed point, wherein the second tuning element is located sufficiently far from the feed point that it does not form a ¼ wave radiating element, but rather serves to tune the higher order resonance(s) of the primary radiating element to a lower frequency band.

Alternatively, this may be achieved by a multi-band radio antenna device comprising: a) a substrate and b) a radiating antenna element comprising: i) a first radiating element resonant at a first frequency band and a second, higher frequency band consisting of a substantially strait portion proximal to the feed point and a tightly meandered section distal from the feed section; ii) a second tuning element connected to the first radiating element and located distally from the feed point, wherein in operation there is a current null between the feed point and the second tuning element when operational in the second, higher frequency band.

Alternatively, this may be achieved by a multi-band radio antenna device comprising: a) a substrate and b) a radiating antenna element comprising: i) a first radiating element resonant at a first frequency band and a second, higher frequency band, consisting of a substantially strait portion proximal to the feed point and a tightly meandered section distal from the feed section; ii) a second tuning element connected to the first radiating element and located distally from the feed point, wherein the second tuning element does not create a new resonance, but only serves to tune the second, higher frequency resonance created on the first radiating element.

Finally, the invention provides an antenna element having a minimal number of contacts at the performance offered. The foregoing has described the principles, preferred embodiments and modes of operation of the present invention. However, the invention should not be construed as being limited to the particular embodiments discussed above. For example, while the antenna of the present invention has been discussed primarily as being a radiator, one skilled in the art will appreciate that the antenna of the present invention would also be used as a sensor for receiving information at specific frequencies. Similarly, the dimensions of the various elements may vary based on the specific application. Thus, the above-described embodiments should be regarded as illustrative rather than restrictive, and it should be appreciated that workers skilled in the art may make variations in those embodiments without departing from the scope of the present invention as defined by the following claims.

Furthermore, it should be emphasized that the term comprising or comprises, when used in this description and in the appended claims to indicate included features, elements or steps, is in no way to be interpreted as excluding the presence of other features elements or steps than those expressly stated. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

The invention claimed is:

1. A multi-band radio antenna device for a radio communication terminal, comprising a substrate, and a radiating antenna element thereon having a radio signal feeding point, said radiating antenna element comprising:

a first radiating portion resonant at a first frequency band, said first radiating portion comprising:

an elongate substantially straight radiating portion arranged proximal to and connected to said signal feeding point, and a tightly meandered radiating portion arranged distal from said radio signal feeding point and connected to said substantially straight radiation portion, said straight radiation portion and said meandered radiation portion forming an antenna having said first resonance frequency; wherein a second radiating portion connected as a branch to said first radiating portion at a bifurcation position thereof arranged distal from said radio signal feeding point, whereby said first radiation portion and said second radiation portion form a combined antenna having a second resonance frequency in which the second frequency is approximately twice the first frequency, wherein said antenna having said first resonance frequency operates as a quarter-wavelength antenna, and said combined antenna having said second resonance frequency operates as a three-quarter-wavelength antenna with the second resonance frequency lowered by said second radiating portion by electrically coupling to the first radiating portion.

2. The device according to claim 1, wherein said bifurcation position is arranged approximately ⅓ to ½ of the total length of the antenna device from said feeding point.

3. The device according to claim 1, wherein said bifurcation position is arranged approximately at a current null position of said second resonance frequency.

4. The multi-band radio antenna device according to claim 1, wherein said first radiating portion, said second radiating portion, and said radio signal feeding point are an integral continuous trace of a conductive material on said substrate.

5. The multi-band radio antenna device according to claim 1, wherein said substrate is a flexible film.

6. The multi-band radio antenna device according to claim 1, wherein said multi-band radio antenna device is arranged on a support element configured to be mounted within a casing of said radio communication terminal.

7. The multi-band radio antenna device according to claim 1, wherein said second radiating portion is arranged adjacent to or slightly separated from said tightly meandered radiating portion.

8. The multi-band radio antenna device according to claim 1, wherein said elongate radiating portion composes approximately ⅓ to ½ of the total length of the multi-band radio antenna device.

9. The multi-band radio antenna device according to claim 1, wherein said tightly meandered radiating portion is electrically longer than said elongate radiating portion.

10. The multi-band radio antenna device according to claim 9, wherein said second radiating portion is shorter than said meandered radiating portion.

11. The multi-band radio antenna device according to claim 1, wherein a matching circuit is applied between the radio signal feeding point and the antenna.

12. The multi-band radio antenna device according to claim 1, comprising an additional branch arranged adjacent the second radiating portion.

13. The multi-band radio antenna device according to claim 12 comprising a ground connection.

14. The multi-band radio antenna device according to claim 13, comprising at least one tuning element which is tuned slightly below the second frequency.

15. The multi-band radio antenna device according to claim 12, wherein the meander radiation portion comprises an end radiating portion having a different pitch.

16. A radio communication terminal intended for multi-band radio communication, comprising an antenna device according to claim 1.

17. The radio communication terminal according to claim 16, wherein the radio communication terminal is a mobile telephone.

18. A manufacturing process for a multi-band radio antenna device according to claim 1, said manufacturing process comprising photo-etching, photo-depositing, precision stamping or insert molding a continuous trace of conductive material forming said first and second radiating portions onto said substrate.

19. The manufacturing process according to claim 18, comprising arranging said multi-band radio antenna device on a support element and mounting said support element within a casing of said radio communication terminal.

20. The manufacturing process according to claim 18, comprising arranging said antenna device on a curved surface.

* * * * *